US005097953A

United States Patent [19]

Gingras

[11] Patent Number: 5,097,953

[45] Date of Patent: Mar. 24, 1992

[54] CARD HOLDING DEVICE

[76] Inventor: Paul Gingras, 22404 Van Buren St., Grand Terrace, Calif. 92324

[21] Appl. No.: 644,603

[22] Filed: Jan. 23, 1991

[51] Int. Cl.[5] ..... B65D 85/48

[52] U.S. Cl. ..... 206/454; 206/45.34; 206/39; 206/449; 206/467; 40/156; 40/124.2; 40/124.4

[58] Field of Search ..... 206/39, 425, 449, 454, 206/466, 468, 470, 461, 45.34, 486, 490, 232; 40/124.2, 124.4, 156, 649; 229/2.5 R

[56] References Cited

U.S. PATENT DOCUMENTS

| | | | |
|---|---|---|---|
| D. 211,186 | 5/1968 | Smith et al. | D6/301 |
| D. 273,565 | 4/1984 | Driskell et al. | 206/461 |
| D. 292,651 | 11/1987 | Stratton | D6/301 |
| 3,371,439 | 3/1968 | Smith et al. | 40/156 |
| 3,463,309 | 8/1969 | Szostek | 206/470 |
| 3,877,165 | 4/1975 | Lumbard | 40/152 |
| 4,016,972 | 4/1977 | Szamborski | 206/470 |
| 4,060,173 | 11/1977 | Dahl | 220/306 |
| 4,322,001 | 3/1982 | Hurley | 206/449 |
| 4,354,601 | 10/1982 | Harrison | 206/232 |
| 4,679,341 | 7/1987 | Goldman | 40/156 |
| 4,681,223 | 7/1987 | Roberts | 206/470 |
| 4,759,838 | 7/1988 | Mayes et al. | 206/454 |
| 4,807,747 | 2/1989 | Hadtke | 206/470 |
| 4,829,691 | 5/1989 | Manjos et al. | 40/661 |
| 4,869,364 | 9/1989 | Bray | 206/232 |
| 4,944,968 | 7/1980 | Wagner | 40/159 |
| 4,979,619 | 12/1990 | Hager | 40/156 |
| 4,995,508 | 2/1991 | Burley | 40/124.2 |

*Primary Examiner*—David T. Fidei
*Attorney, Agent, or Firm*—Foley & Lardner

[57] ABSTRACT

A card holding device is provided which comprises a lower section and an upper section. The lower section comprises a surface having a recessed portion having a depth for receiving a card, the depth being approximately equal to the thickness of the card, the recessed portion comprising a lower display panel for contacting a first surface of the card and indentations for enclosing each of the corners of the card without contacting the corners, and a first channel disposed about the surface, the inner surface of the channel defining a female mating surface. The upper section comprises an upper display panel for contacting a second surface of the card, a second channel disposed about the upper display panel, the outer surface of the second channel defining a male mating surface, a peripheral surface disposed about said second channel, and an outer sidewall descending from said peripheral surface. The male mating surface of the upper section engages the female mating surface of the lower section, and the lower and upper display panels engage the first and second surfaces of the card, respectively, thereby allowing the card to be displayed.

11 Claims, 7 Drawing Sheets

CARD HOLDING DEVICE

BACKGROUND OF THE INVENTION

The present invention relates to a device suitable for the storage of image-bearing media, in particular cards such as baseball, football or other sports cards.

The growing popularity of collecting and trading sports cards has resulted in a significant increase in the value of many cards, such as cards depicting Baseball Hall of Fame inductees, or rare cards depicting obscure players. Consequently, the need has increased for means for protecting cards, in particular the corners thereof, from damage. Protection of cards from excessive exposure to air is also desirable in order to prevent, e.g., yellowing.

Numerous devices for displaying and protecting cards or other image bearing media are known. Card holders are disclosed, for example, in U.S. Pat. No. 4,829,691 and the references cited therein. Display devices for displaying multiple image-bearing media such as cards, photographs and the like are revealed, e.g., in U.S. Pat. No. 3,371,439.

U.S. Pat. No. 4,829,691, to Manjos et al., describes a one-piece card display holder and protector having a transparent, recessed front panel and a transparent, second panel having a projecting surface, the two panels being connected together along a common hinge line. A card is held within the space defined by the recess of the front panel and the projecting surface of the second panel. However, since the edges and corners of the card engage the edges and corners of the recessed area, insufficient protection may be provided to prevent the corners of the card from being damaged when the card is removed from or placed within the recess.

U.S. Pat. No. 3,371,439, to Smith, reveals a display holder including interlocking matrix and grid units defining multiple tray-like display areas. However, the rounded corners of the display areas provide no protection against damage to the corners of cards displayed therein. Moreover, although the cards can be individually inserted or removed through notches in the matrix unit, such insertion or removal requires bending of the cards and thus can damage the cards, especially the corners thereof.

SUMMARY OF THE INVENTION

Accordingly, it is an object of the present invention to provide a card holding device that protects cards, such as sports cards, from damage, in particular to the corners thereof, and also prevents excessive exposure to air.

Another object of the present invention is to provide a card holding device that allows display of both sides of the card held therein.

A further object of the present invention is to provide a card holding device for displaying a plurality of cards, while allowing easy replacement of individual cards without damage.

Still another object of the present invention is to provide a card holding device that is easy to manufacture.

In accomplishing the foregoing objectives, there has been provided, in accordance with one aspect of the present invention, a card holding device which comprises a lower section and an upper section. The lower section comprises a surface having a recessed portion having a depth for receiving a card, the depth being approximately equal to the thickness of the card, the recessed portion comprising a lower display panel for contacting a first surface of the card and indentations for enclosing each of the corners of the card without contacting the corners, and a first channel disposed about the surface, the inner surface of the channel defining a female mating surface. The upper section comprises an upper display panel for contacting a second surface of the card, a second channel disposed about the upper display panel, the outer surface of the second channel defining a male mating surface, a peripheral surface disposed about said second channel, and an outer sidewall descending from said peripheral surface. The male mating surface of the upper section engages the female mating surface of the lower section, and the lower and upper display panels engage the first and second surfaces of the card, respectively, thereby allowing the card to be displayed.

In a preferred embodiment of the card holding device according to the invention, the lower section further comprises a flange disposed about the second channel. The flange and the peripheral surface preferably are substantially coplanar with the surface having the recess and with the upper display panel, respectively.

In another preferred embodiment, the channel is substantially rectangular in cross-section.

In accordance with another aspect of the present invention there is provided a multiple card holding device which comprises a plurality of card holding devices as defined above, wherein the upper sections of the plurality of card holding devices are sequentially linked by joining strips. In a preferred embodiment, the upper sections of the upper unit are joined by integral hinges, allowing the device to be flexed easily and thus to stand freely more readily.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWING

The invention may be more readily understood by referring to the accompanying drawing by which

Like features are numbered the same throughout all figures.

DETAILED DESCRIPTION OF PREFERRED EMBODIMENTS

The channels in the upper and lower sections, respectively, preferably are in the shape (in plan view) of a rectangle that surrounds the display surface and the card to be displayed. Other shapes, such as circles, ellipses, octagons, etc., are also possible, as long as sufficient room is provided for the recess and the indentations that protect the card's corners.

Preferably, the channels have substantially rectangular cross-sections, which allow a high degree of engagement of the upper and lower sections, and provide superior air-tightness. The channels may have other cross-sections as well; in particular, the lower part of the channel can have a U-shaped cross section.

The indentations for protecting the corners of the card to be displayed may be of any desired shape, such as substantially circular, elliptical, rectangular, etc.

Figure 1:
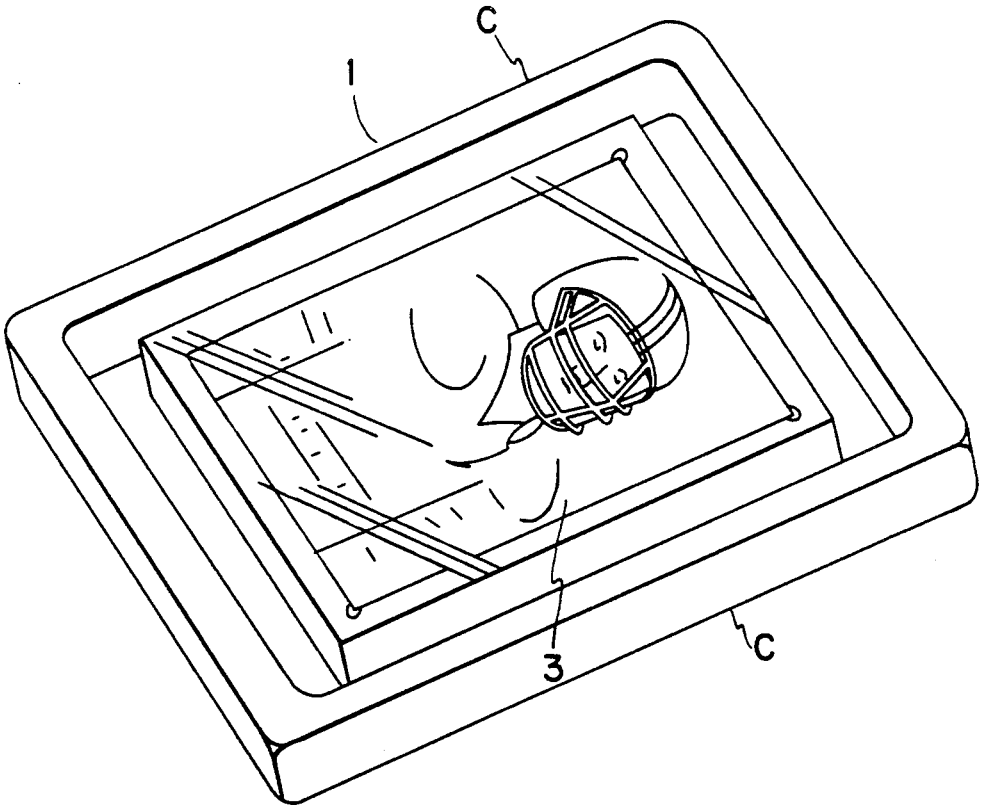
FIG. 1 is a perspective view of a card holding device according to the present invention holding a card.
Figure 2:
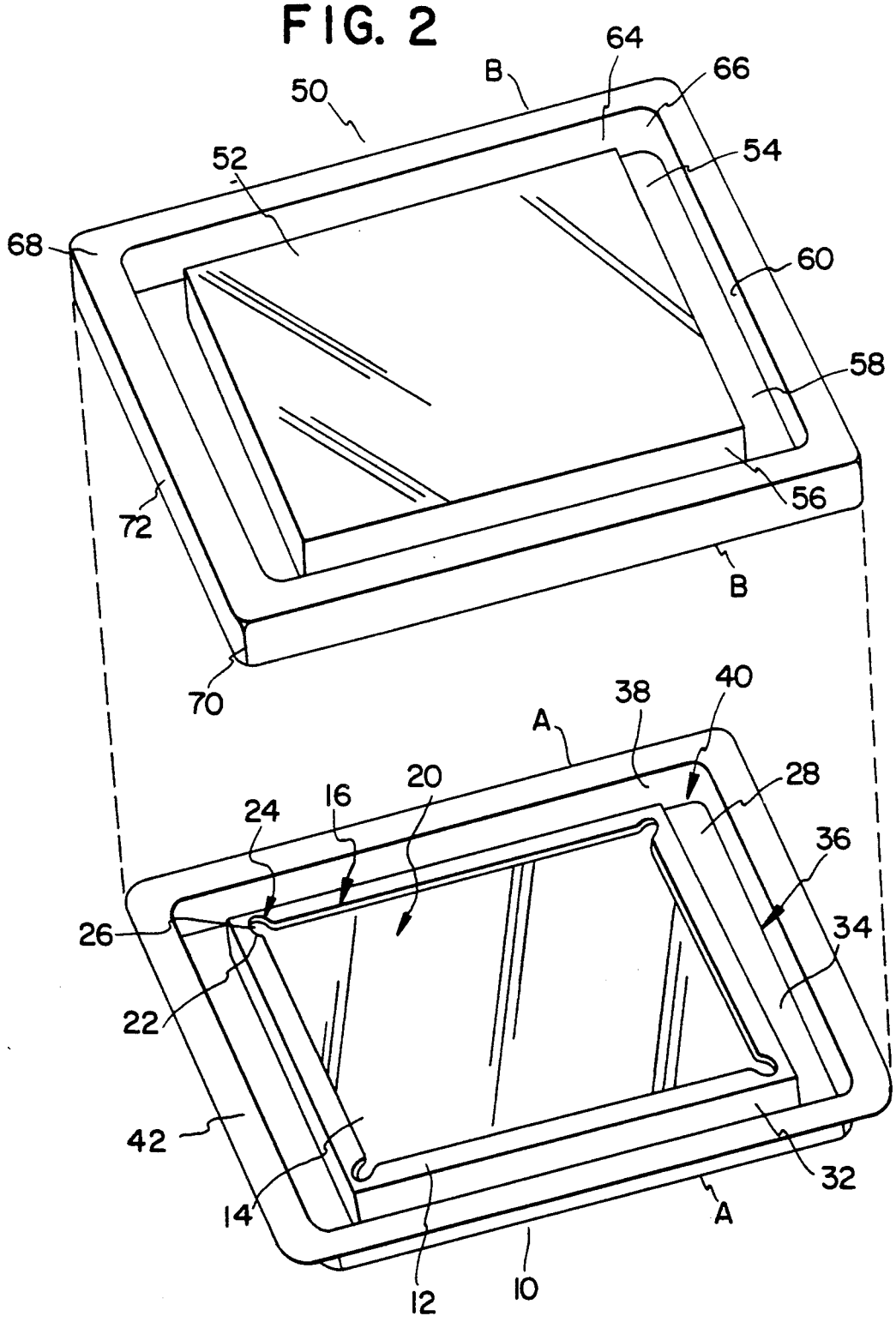
FIG. 2 is an exploded perspective view of a card holding device according to the instant invention showing the upper and lower sections of the card holding device properly aligned to permit engagement thereof.

Referring now to the drawing, FIG. 1 shows a preferred embodiment of a card holder 1 according to the present invention holding therein a card 3. The lower section 10 and upper section 30 of card holder 1 are shown in FIGS. 2–5. Each of the upper and lower sections can be formed from a single piece of, e.g., a transparent plastic material such as PETG, PET, PVC, etc. Or, a plurality of such sections can be stamped from a single sheet and subsequently separated. Other suitable means, such as molding, can also be employed to produce the upper and lower sections.

Lower section 10 includes a surface 12 having a recess 14 defined by recess walls 16 descending from surface 12 to a depth approximately equal to the thickness of the card to be displayed. The recess walls 16 form engagement surfaces for engaging the edges of the card to be displayed. Recess 12 is further defined by lower display panel 20, which joins with recess walls 16 and is substantially parallel with surface 12, and which engages a first surface of the card to be displayed, and by indentations 22 having indentation walls 24 descending from surface 12 to indentation floors 26. Indentation floors 26 are preferably substantially coplanar with lower display panel 20, but may protrude slightly beneath the level of the panel.

Figure 9:
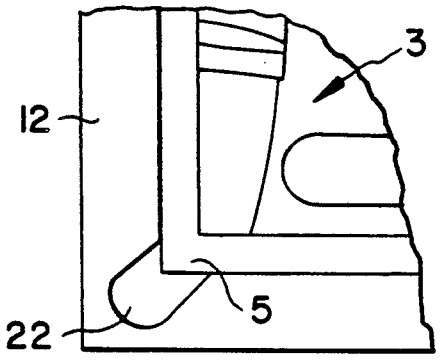
FIG. 9 is an fragmentary enlarged plan view of a corner of the recessed portion of the lower section of a card holding device according to the present invention, showing engagement of a card within the recess thereof and protrusion of a corner of the card within a protective corner indentation.

As shown in FIG. 9, indentations 22 surround the corners 5 of card 3 without contacting the corners. This protects the corners from damage. The indentations 22, as noted, may be of any desired shape.

Figure 10:
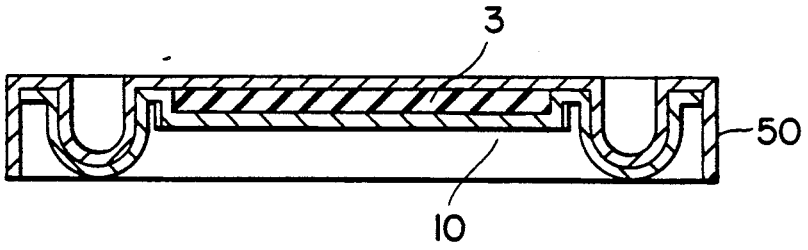
FIGS. 10–12 are cross-sectional views of additional embodiments of a card holding device according to the present invention.
Figure 11:
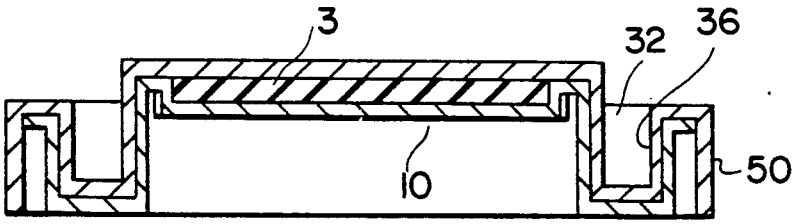
Figure 12:
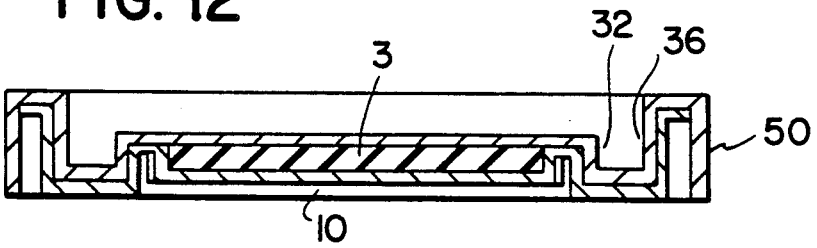

Disposed about surface 12 is lower channel 28. Channel 28 is defined by inner wall 32, channel floor 34 and outer wall 36. In a preferred embodiment, the walls 32 and 36 and channel floor 34 define a channel having a substantially rectangular cross-section. However, other cross-sections are also possible. For example, floor 34 can have a radius of curvature, yielding a channel cross-section having a bottom section with an approximate U-shape as in FIG. 10. Also, outer wall 36 can have a height less than (FIG. 11) or greater than (FIG. 12) the height of inner wall 32. In these embodiments, the card is thus displayed in a projecting or recessed manner. The inner and outer channel corners 38 and 40 can independently be, for example, rounded or squared, or have another desired shape.

In a preferred embodiment, lower section 10 further comprises a flange 42 disposed about channel 28 and joining the top of outer wall 36. In the preferred embodiment in which inner and outer channel walls 32 and 36 are of the same height, flange 42 is substantially coplanar with surface 12. In other embodiments, flange 42 is substantially parallel with surface 12. Corner 44 of flange 42 can have any desired shape, for example, rounded or squared.

Upper section 50 includes upper display panel 52, about which is disposed upper channel 54. Channel 54 is defined by inner wall 56, channel floor 58 and outer wall 60. The cross-section of upper channel 54 will in every embodiment correspond to the cross-section of lower channel 28. Again, inner and outer corners 64 and 66 of upper channel 54 can be independently rounded or squared, and will correspond to corners 38 and 40 of lower channel 28.

Disposed about upper channel 54 is peripheral surface 68 having corners 70, which can have any desired shape, such as rounded or squared. Descending from peripheral surface 68 is side wall 72. Side wall 68 can descend vertically or outwardly at a small angel from the vertical.

Figure 6:
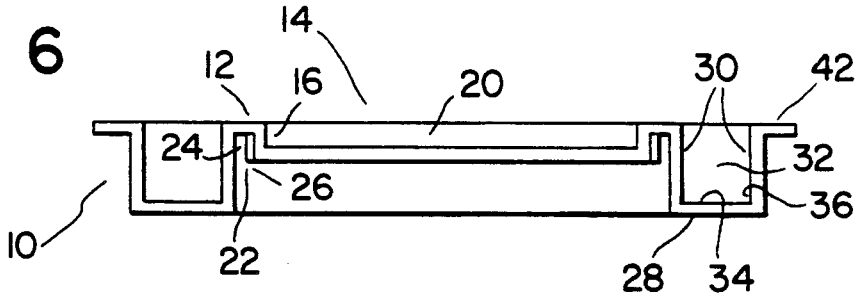
FIG. 6 is a cross-sectional view of the lower section shown in FIG. 2, taken along line A—A.
Figure 7:
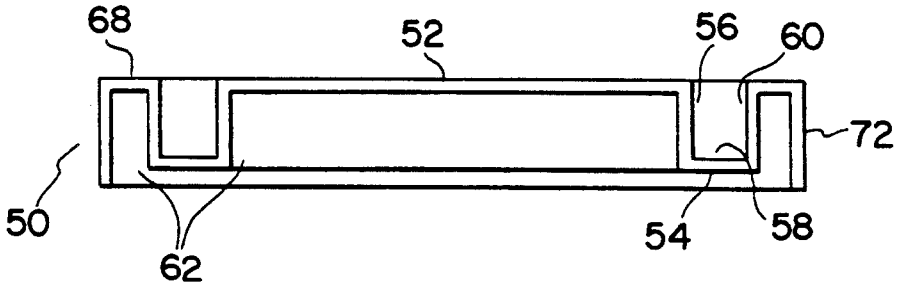
FIG. 7 is a cross-sectional view of the upper section shown in FIG. 2, taken along line B—B.
Figure 8:
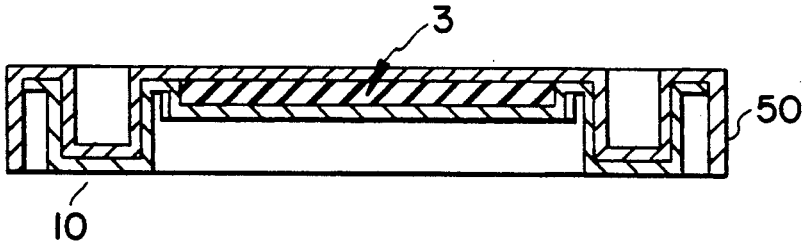
FIG. 8 is a cross-sectional view of the card holding device shown in FIG. 1, taken along line C—C, showing how the card to be displayed is enclosed between the upper and lower sections thereof.

As is evident from FIGS. 6–8, the inner surfaces of inner wall 32, channel floor 34, outer wall 36, and if present, flange 42, together with surface 12, define a female mating surface 30, while the outer surfaces of inner wall 56, channel floor 58, outer wall 60, and upper peripheral surface 68, together with the outer portion of upper display panel 52 that corresponds to surface 12, define a male mating surface 62. The upper and lower sections of the card displaying device are thus locked together by engaging the female mating surface 30 with the male mating surface 62. The lower display panel 20 and the remaining portion of upper display panel 52 then engage the first and second sides of card 3, respectively, securing the card in place for display, as is clear from FIG. 8. Preferably, side wall 68 descends approximately to the level defined by the lower surface of channel floor 34 when upper section 50 is engaged with lower section 10, as shown in FIG. 8. The side wall may, however, descend to a lower level if desired.

Figure 3:
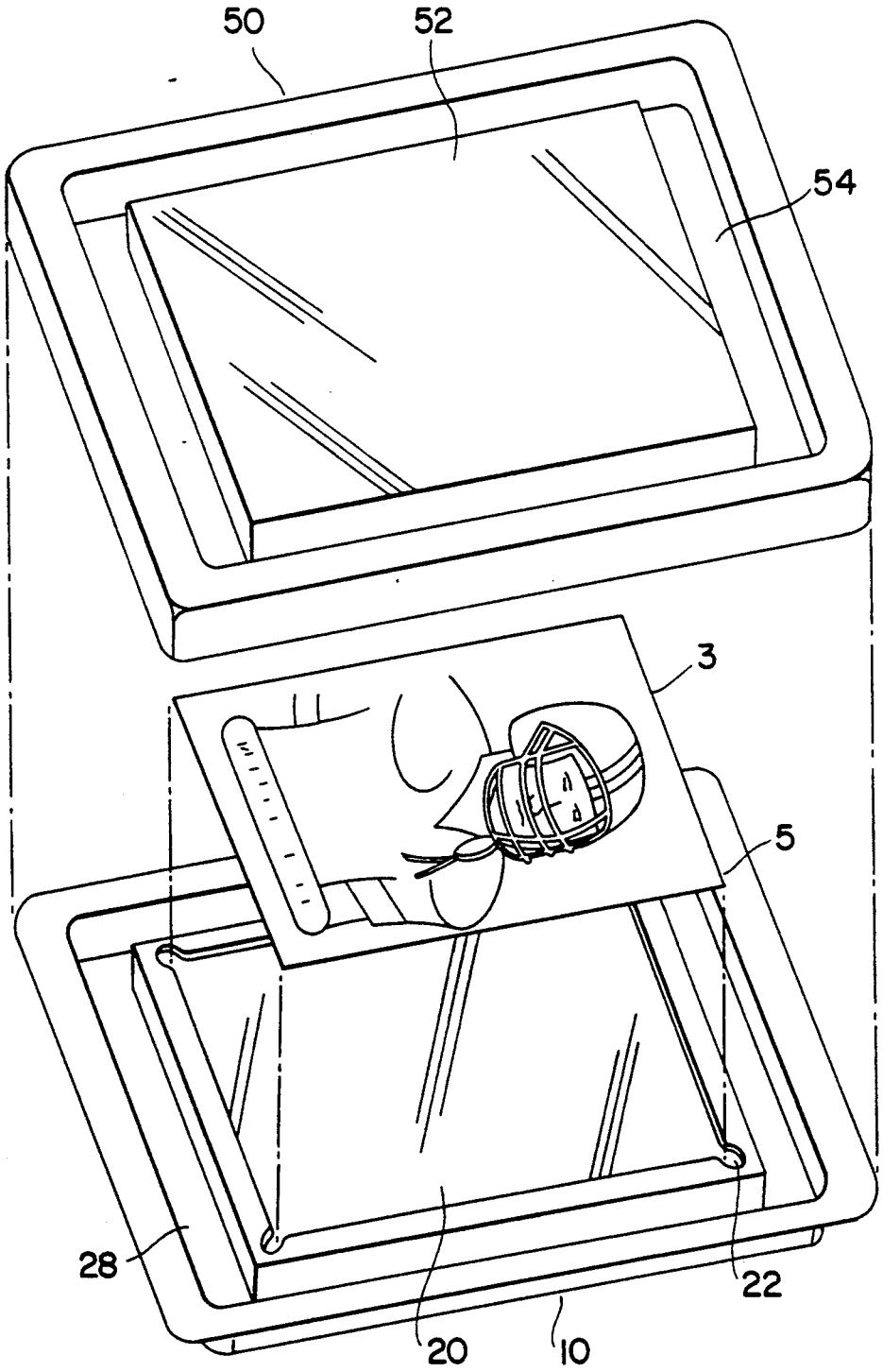
FIG. 3 is an exploded perspective view of card holding device according to the present invention showing the upper and lower sections thereof properly aligned, and a card in position for placement in the recess of the lower section thereof.
Figure 4:
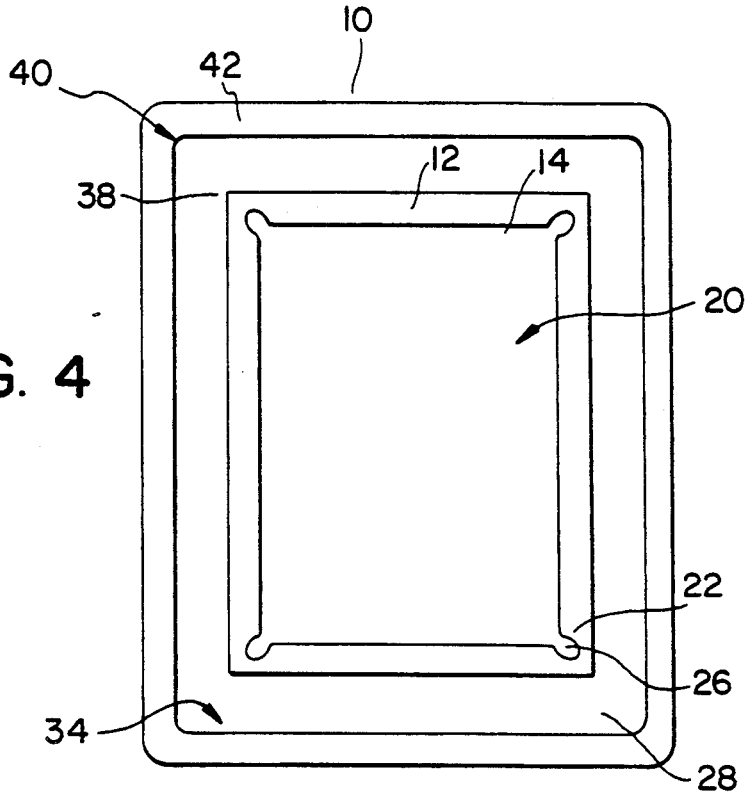
FIG. 4 is a plan view of the lower section of a card holding device according to the present invention.
Figure 5:
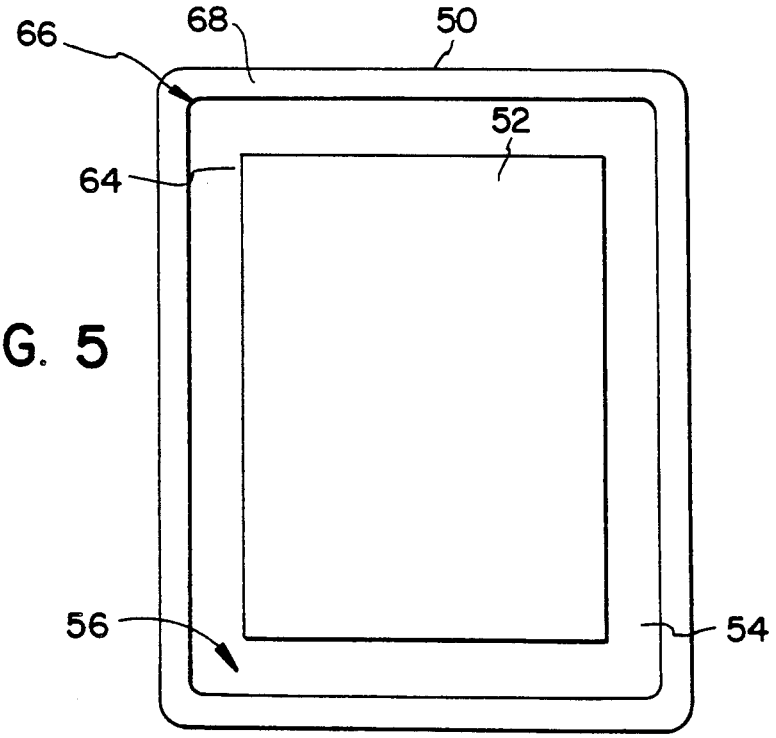
FIG. 5 is a plan view of the upper section of a card holding device according to the instant invention.

FIG. 3 illustrates a preferred method of using a multiple card holding device according to the instant invention. Card 3 is placed within recess 14 of lower section 10, such that lower display panel 20 engages the lower surface of the card and indentations 22 surround the corners 5 of the card. Upper section 50 is then positioned over lower section 10 such that upper channel 54 and lower channel 28 are in alignment. The two sections are then pressed together, with male mating surface 62 engaging female mating surface 30 and upper display panel 52 engaging the upper surface of card 3.

Figure 13:
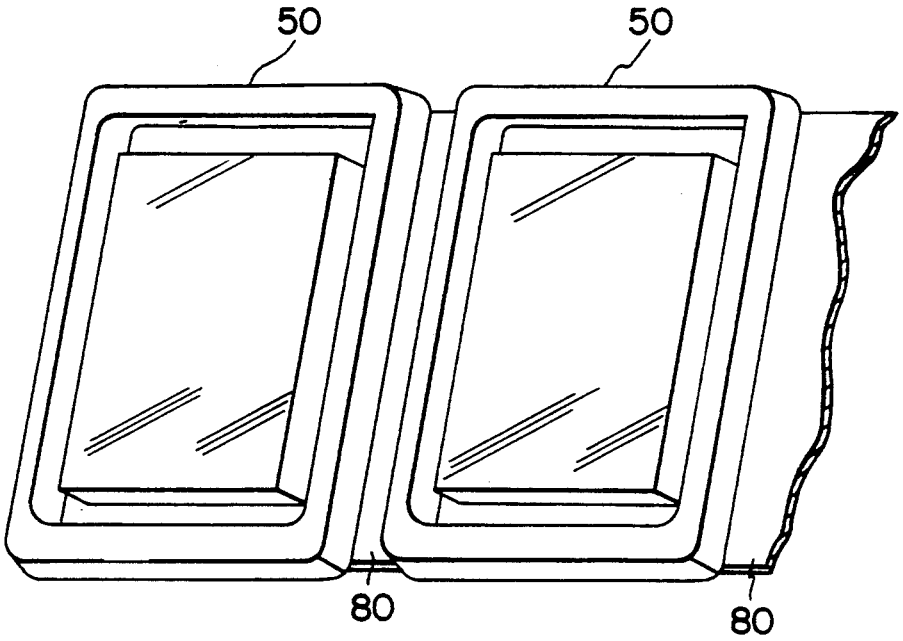
FIG. 13 is a perspective view of another embodiment of a card holding device according to the instant invention, showing multiple upper sections joined by joining strips.
Figure 14:
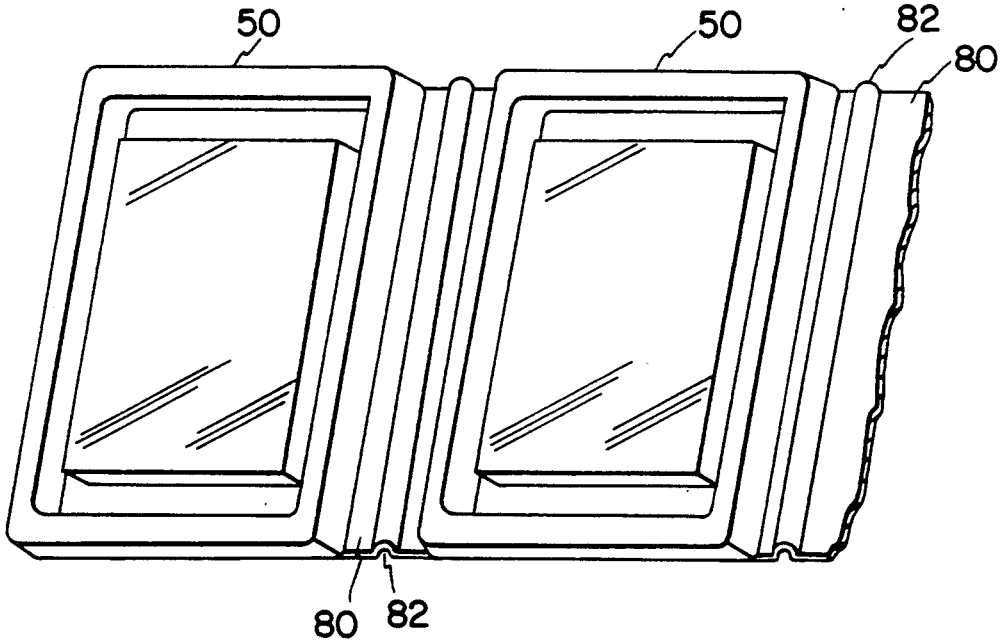
FIG. 14 is a perspective view of another embodiment of a card holding device according to the instant invention, showing multiple upper sections joined by joining strips having integral hinges.

FIGS. 13 and 14 depict additional embodiments of a card holding device according to the instant invention. In FIG. 13, a multiple card holding device includes a plurality of card holding devices 10, the multiple upper sections 50 of which are connected by joining strips 80. Multiple lower sections 10, not shown, are separately mated to each upper section 50. The lower sections are not joined to each other, but can be removed and rejoined individually, allowing access to each individual card displayed without exposure of the remaining cards.

A multiple card holding device according to the present invention can be produced by stamping a single plastic sheet to form an upper unit having multiple upper sections, in which case the joining strips would be formed by sections of the plastic sheet remaining unstamped. Other suitable means for producing the upper unit, such as individual formation of the plurality of upper sections followed by bonding to the necessary joining strips, can also be employed. The lower sections can be produced in the manners previously described.

FIG. 14 shows another embodiment of a multi-card holding device including hinges 82 integral with joining strips 80. This embodiment allows easier bending of the multi-card device, and thus facilitates free-standing display of the cards enclosed therein.

What is claimed is:

1. A card holding device which comprises:

(a) a lower section comprising (1) a surface having a recessed portion having a depth for receiving a card, said depth being approximately equal to the thickness of said card, said recessed portion comprising (A) a lower display panel for contacting a first surface of said card, and (B) indentations for enclosing each of the corners of said card without contacting said corners; and (2) a first channel disposed about said surface, the inner surface of said channel defining a female mating surface; and (b) an upper section comprising:

(1) an upper display panel for contacting a second surface of said card;

(2) a second channel disposed about said upper display panel, the outer surface of said second channel defining male mating surface;

(3) a peripheral surface disposed about said second channel; and (4) an outer sidewall descending from said peripheral surface, whereby said male mating surface of said upper section engages said female mating surface of said lower section, and said lower and upper display panels engage said first and second surfaces of said card, respectively, thereby allowing said card to be displayed.

2. A card holding device as claimed in claim 1, wherein said lower section further comprises a flange disposed about said second channel.

3. A card holding device as claimed in claim 2, wherein said flange of said lower section is substantially coplanar with said surface having said recess, and said peripheral surface of said upper section is substantially coplanar with said upper display surface.

4. A card holding device as claimed in claim 1, wherein said upper display surface projects above the plane of said peripheral surface of said upper section.

5. A card holding device as claimed in claim 1, wherein said peripheral surface of said upper section projects above the plane of said upper display surface of said upper section.

6. A card holding device as claimed in claim 1, wherein said first and second channels are substantially rectangular in cross-section.

7. A card holding device as claimed in claim 1, wherein said indentations are substantially circular or elliptical in outline.

8. A multiple card holding device which comprises a plurality of card holding devices as claimed in claim 1, wherein the upper sections of said plurality of card holding devices are sequentially linked by joining strips.

9. A multiple card holding device as claimed in claim 8, wherein each of the lower sections of said plurality of card holding devices further comprises a flange disposed about said second channel.

10. A multiple card holding device as claimed in claim 8, wherein said joining strips are flexible.

11. A multiple card holding device as claimed in claim 8, further comprising a hinge integrally molded within each said joining strip.

* * * * *